US005915809A

United States Patent [19]

Gilliam

[11] Patent Number: 5,915,809

[45] Date of Patent: Jun. 29, 1999

[54] MASONRY COLUMN GUIDE

[76] Inventor: Jim A. Gilliam, 1038 Rushing Dr., Arnaudville, La. 70512-9803

[21] Appl. No.: 08/782,384

[22] Filed: Jan. 13, 1997

[51] Int. Cl.[6] ..... G01C 15/10

[52] U.S. Cl. ..... 33/518; 33/404; 33/408

[58] Field of Search ..... 33/404, 406, 518, 33/533, 562, 645

[56] References Cited

U.S. PATENT DOCUMENTS

| | | | |
|---|---|---|---|
| 2,641,846 | 6/1953 | Zeno | 33/404 |
| 3,348,312 | 10/1967 | Jones | 33/404 |
| 3,457,649 | 7/1969 | Rodgers . | |
| 3,768,167 | 10/1973 | Viau | 33/85 |
| 4,057,903 | 11/1977 | Cantera | 33/339 |
| 4,631,833 | 12/1986 | Moye . | |
| 4,866,851 | 9/1989 | Mills . | |
| 4,970,797 | 11/1990 | Sarasin . | |
| 5,001,839 | 3/1991 | Jones . | |

*Primary Examiner*—Bernard Roskoski
*Attorney, Agent, or Firm*—Robert Montgomery

[57] ABSTRACT

An apparatus and process for assisting a mason in laying brick columns, the apparatus comprising a telescopic vertical mast, a vertical alignment assembly further comprising pivotally attached telescopic legs for maintaining the vertical mast plumb, a lower guide bar in contact with first and second courses of bricks for insuring vertical stability, an adjustable upper guide hoop attached to a rolling truck in contact with the vertical mast for maintaining a perimeter guide for laying bricks in a column and an upper telescopic member attachable to a structure around which the brick column is being laid or adjacent thereto, for providing vertical alignment in addition to or in lieu of the telescopic legs. The truck assembly and upper guide hoop are in rolling contact with a portion of the mast and moved incrementally by releasing a friction brake. The lower guide and upper hoop are incrementally adjustable to fit various size columns.

19 Claims, 8 Drawing Sheets

MASONRY COLUMN GUIDE

BACKGROUND OF THE INVENTION

1. Field of the Invention

The present invention relates to masonry guides for use in laying brick in general and more particular to the laying of brick columns.

2. General Background

Masonry guides have long been used to aid the mason in the proper alignment of successive courses of brick or block. A specific aspect of masonry deals with the construction of piers or columns. Such columns are used as support structures for frame construction, iron fences, decorative covering for structural members and the like. It is essential that courses of each successive layer of such columns be both plumb and level. Since in many cases the construction of brick or block columns is more decorative than functional, and time spent leveling and aligning the column simply adds cost to the construction process, it is therefore highly desirable that equipment be developed which will reduce labor cost. Efforts in this regard include such devices as those taught in U.S. Pat. Nos. 3,457,649, 4,631,833, 4,866,851, 4,970,797, and 5,001,839. However, each of these patents teaches the necessity of attaching the guides in some manner to the structure being built or at least to a frame structure adjacent the brick work. When constructing a brick column, it is simply not practical to attach the coursing guide to the brick work and in some cases there is no adjacent frame structure available to which the guide may be attached. It is also essential that a brick column guide mechanism be erected and utilized as quickly as possible without the need to secure and align brackets and other such attachments to the lower courses before a guide mechanism can be employed. When erecting brick columns it is very time consuming to use strings and erect corner posts to ensure true vertical and horizontal coursing due to the very short runs in each direction. Therefore, there is a need to provide a brick coursing guide which can be easily erected by a brick layer, aligned independently of the building structure, adjusted incrementally from the first course to any reasonable height and adjusted incrementally for various size columns.

SUMMARY OF THE PRESENT INVENTION

The invention as taught herein is a brick layer's guide for constructing brick columns in a rapid manner. The guide, being telescopic and constructed from aluminum or polymeric materials, is therefore both light weight and compact. The guide can be rapidly set up and easily adjusted, via telescopic legs, to obtain vertical plumb on virtually all terrain and in close confined spaces, such as under existing structures, or extended for tall columns. Adjustable guide frames are provided conforming to convenient size columns. However, other unusual size or shape frame guides may be provided or constructed for attachment to the column guide. A lower guide frame attached to a telescopic mast member is provided which maintains contact with the lower courses as they are set, thus increasing stability and insuring alignment of the course being laid based on previous courses. A rolling truck in frictional contact with the mast is provided which allows an upper frame or hoop attached thereto, surrounding the column being laid, to be moved easily, without binding, as each course is laid incrementally as measured along a scale attached to the mast. A second telescopic member is fitted to the upper end of the column guide's vertical mast which allows infinite adjustment for the temporary attachment of the second telescopic member to existing structures, such as under eves or to a structural support around which the brick column is being built, thereby, providing alternative or additional vertical support and plumb alignment to the guide's vertical mast. Utilizing the brick column guide allows the brick layer to reduce time and lay each course to exacting dimensions as rapidly as possible without stopping to relevel each course often stopping only to let the mortar dry sufficiently.

BRIEF DESCRIPTION OF THE DRAWINGS

For a further understanding of the nature and objects of the present invention, reference should be made to the following detailed description, taken in conjunction with the accompanying drawings, in which like parts are given like reference numerals, and wherein.

DESCRIPTION OF THE PREFERRED EMBODIMENT

Figure 1:
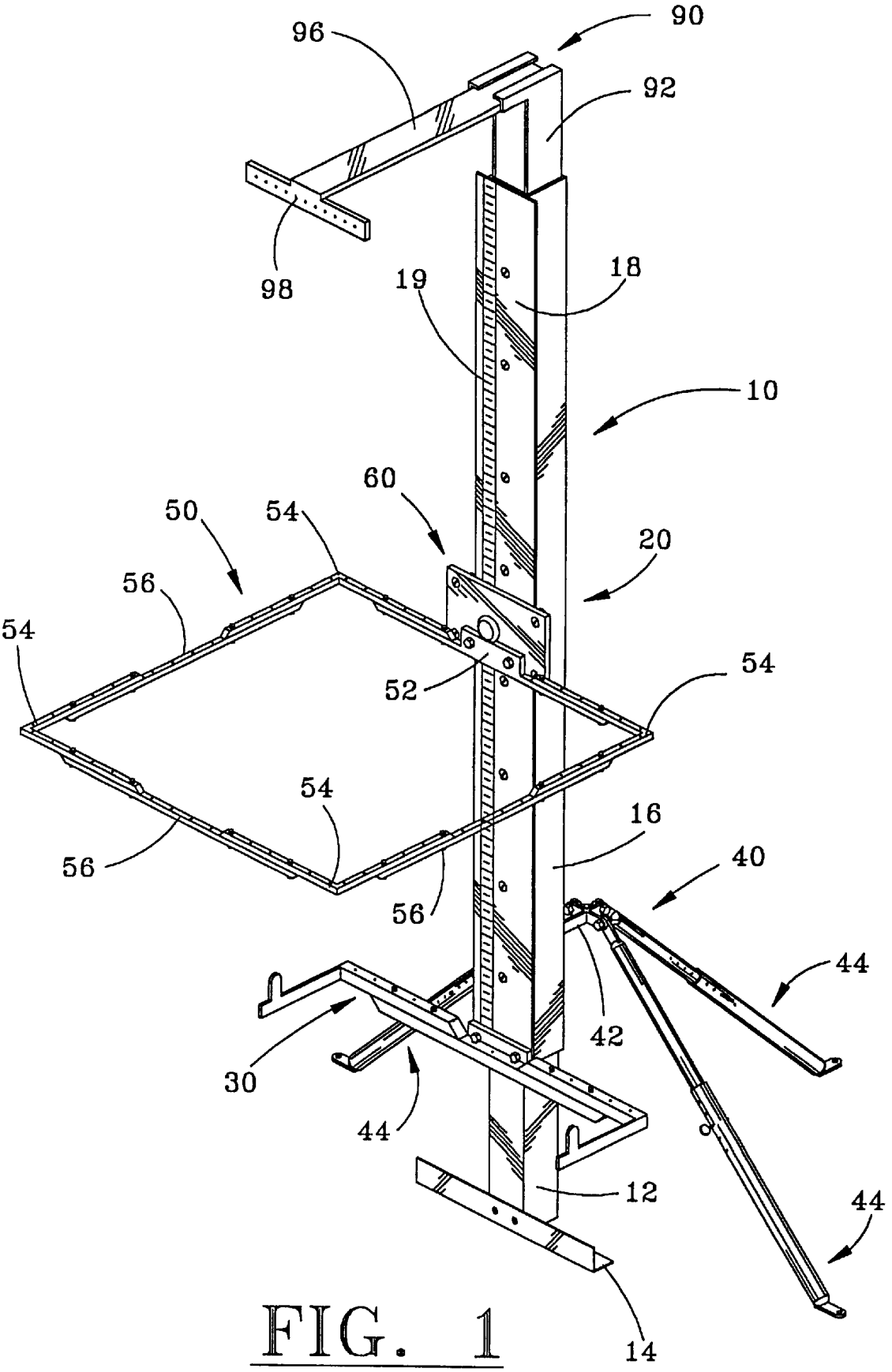
FIG. 1 is an isomeric view of the preferred embodiment of the invention.
Figures 2, 3:
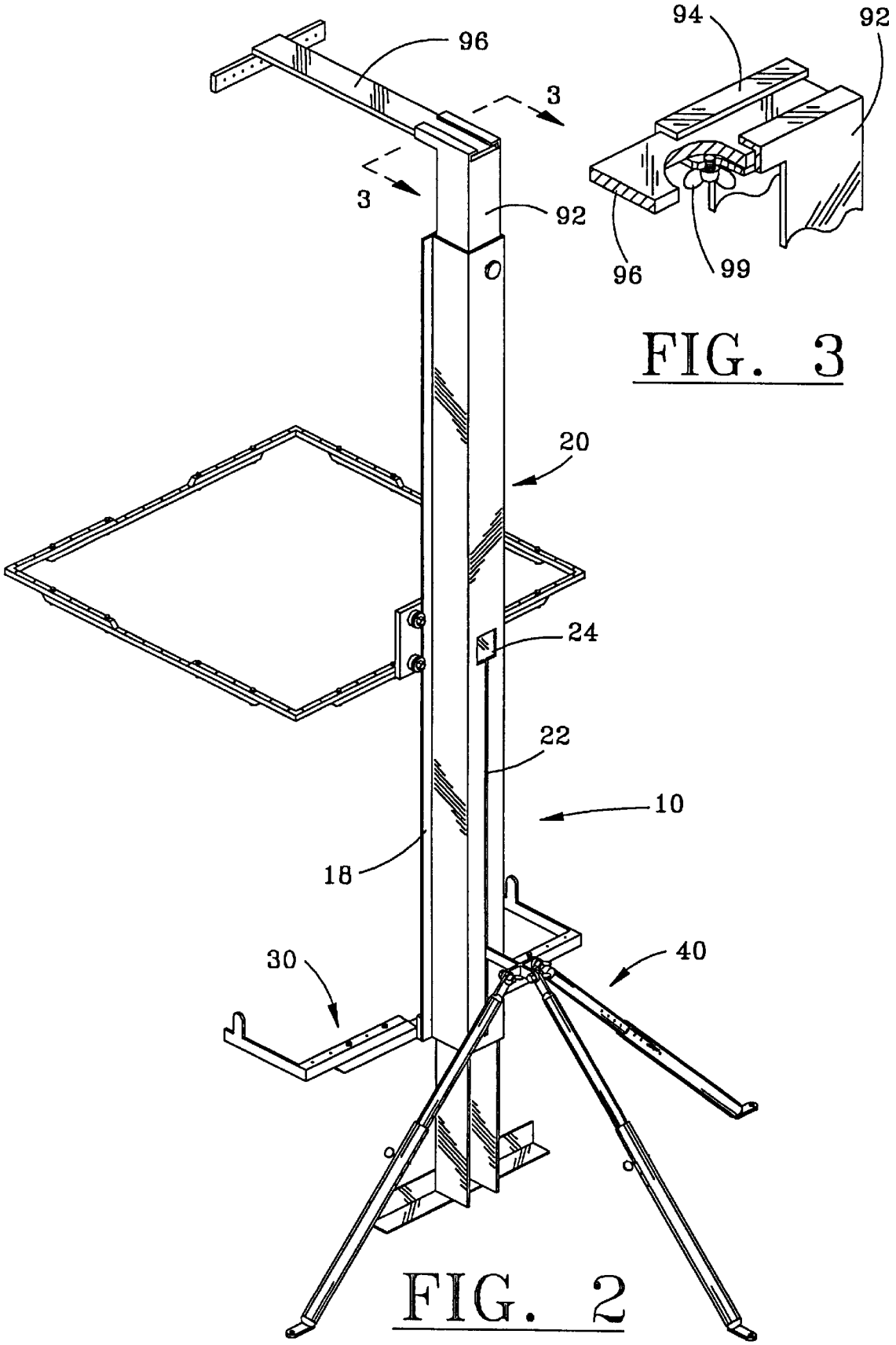
FIG. 2 is a rear isometric view of the preferred embodiment of the invention.
FIG. 3 is a partial isometric cross section of a portion of the embodiment shown in FIG. 3 taken along sight line 3—3.
Figures 4, 5:
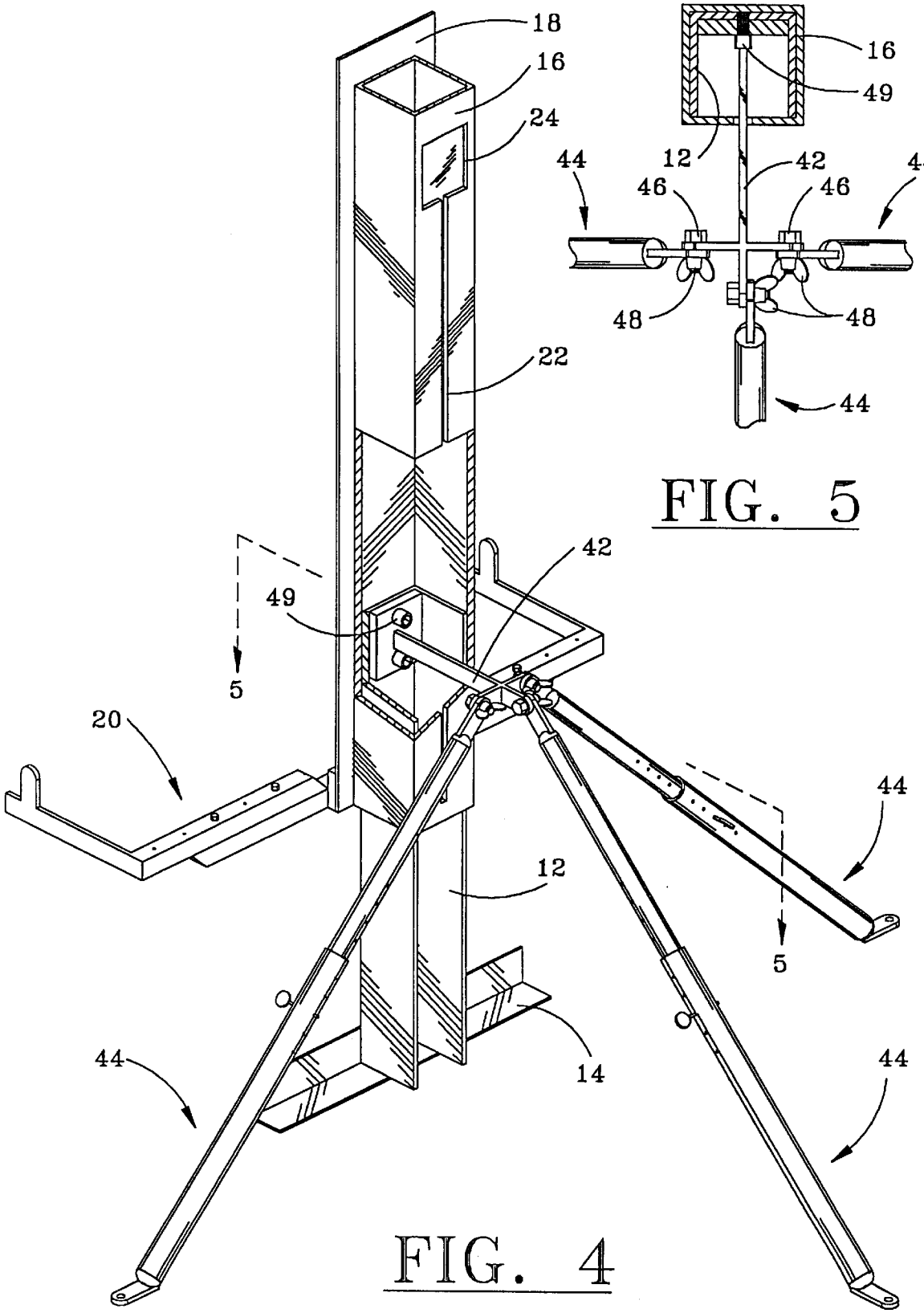
FIG. 4 is a partial isometric cross section of preferred embodiment shown in FIG. 2.
FIG. 5 is a partial cross sectional plan view of the preferred embodiment shown in FIG. 4 taken along sight line 5—5.
Figure 6:
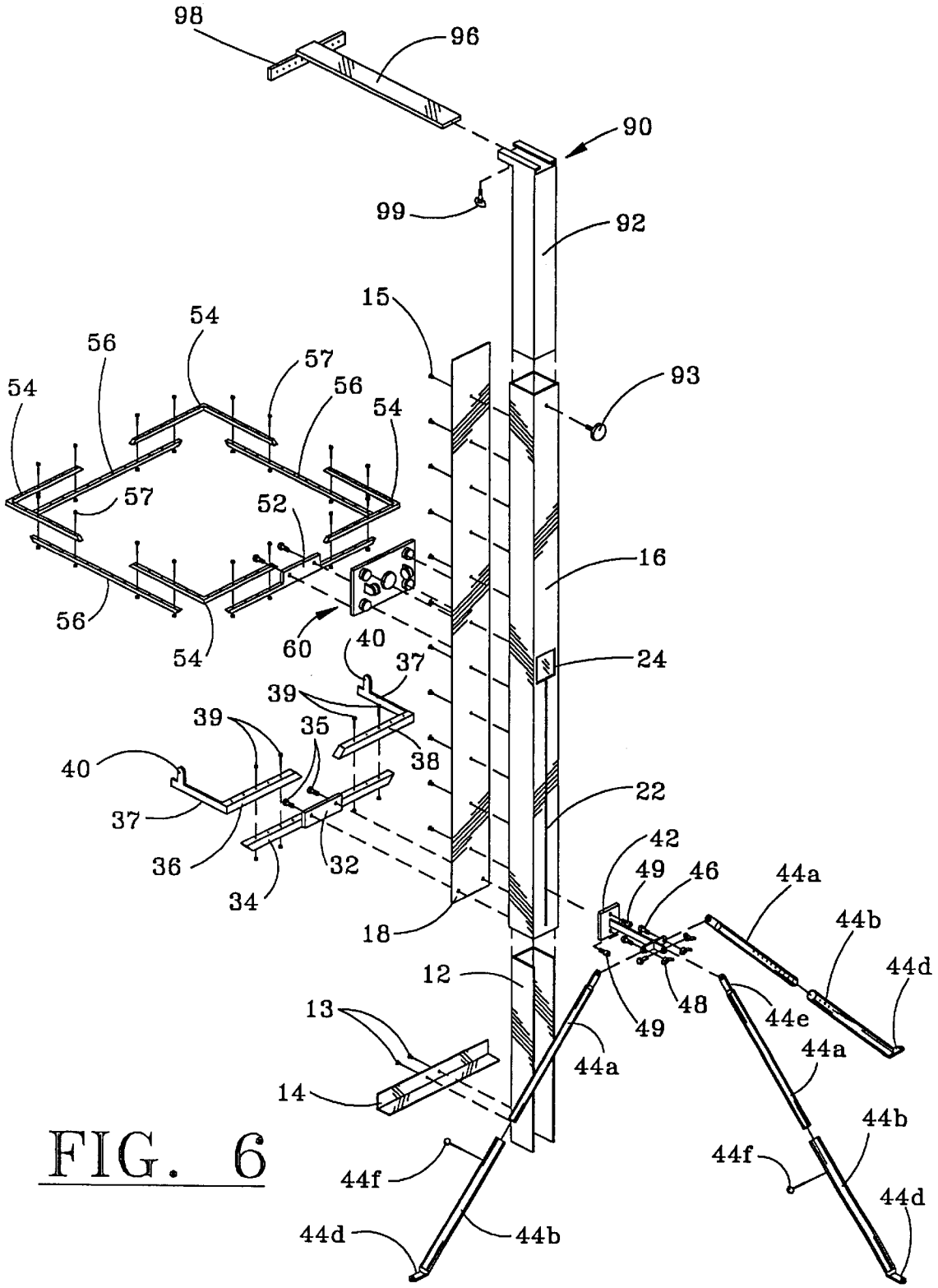
FIG. 6 is an exploded view of the preferred embodiment.
Figure 7:
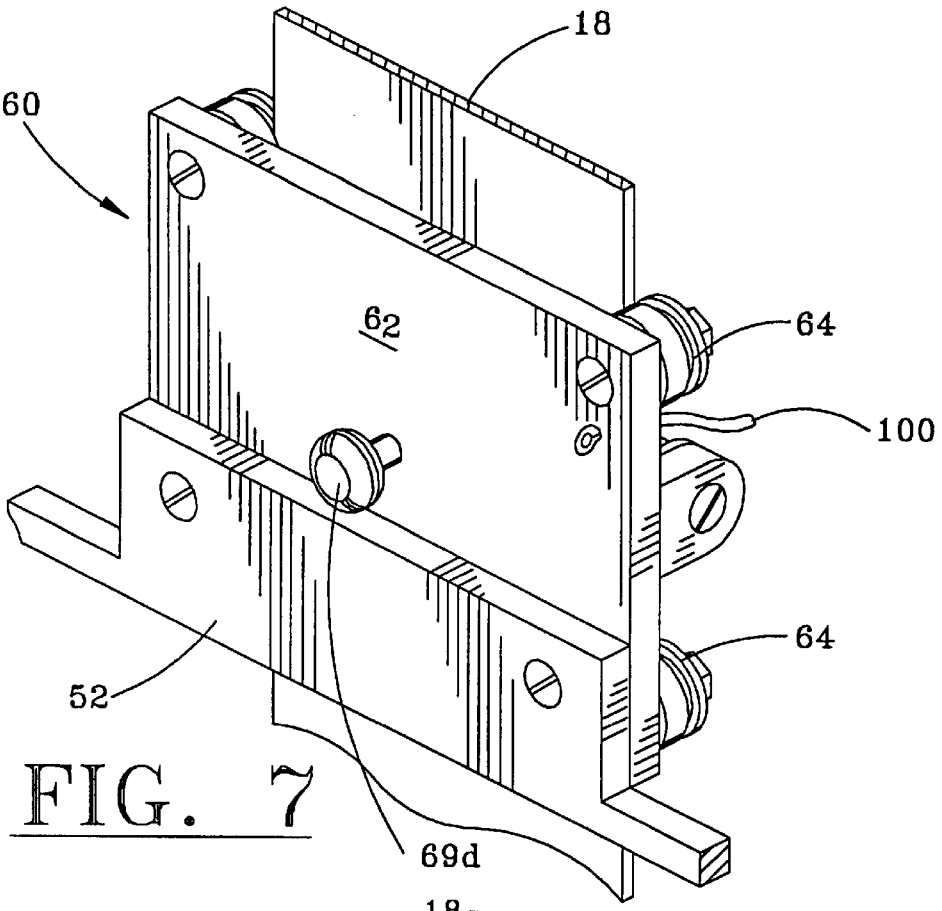
FIG. 7 is a front isometric view of the mast truck assembly.
Figure 8:
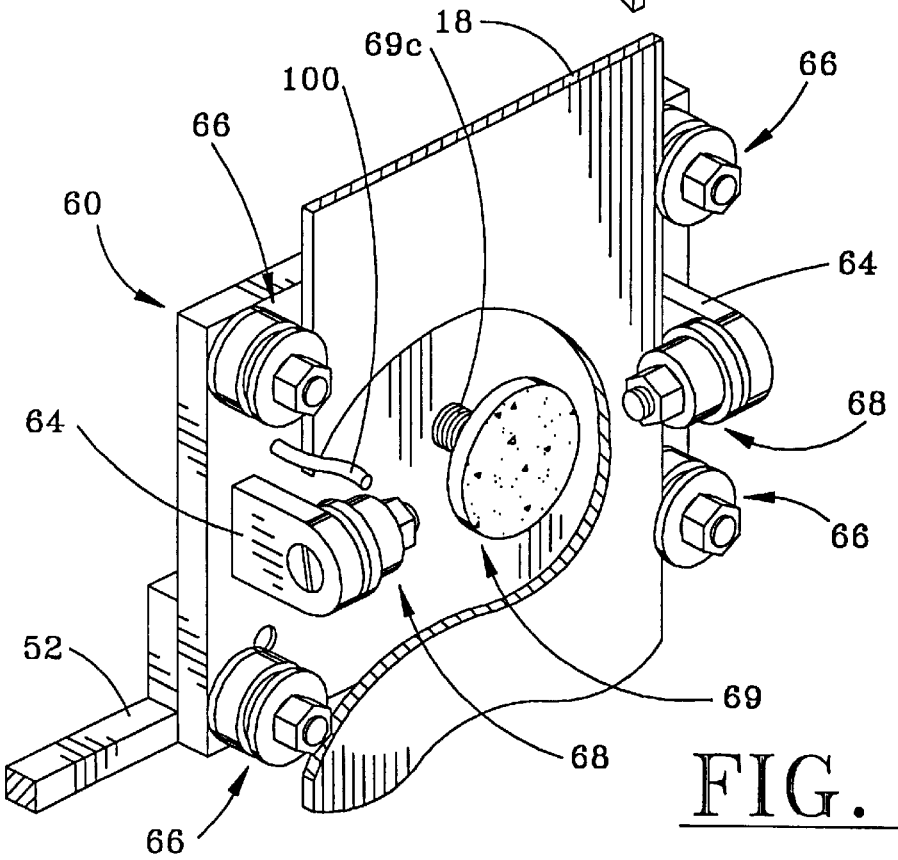
FIG. 8 is rear isometric view of the mast truck assembly and a portion of the face plate with cut-away showing locking dog.
Figure 9:
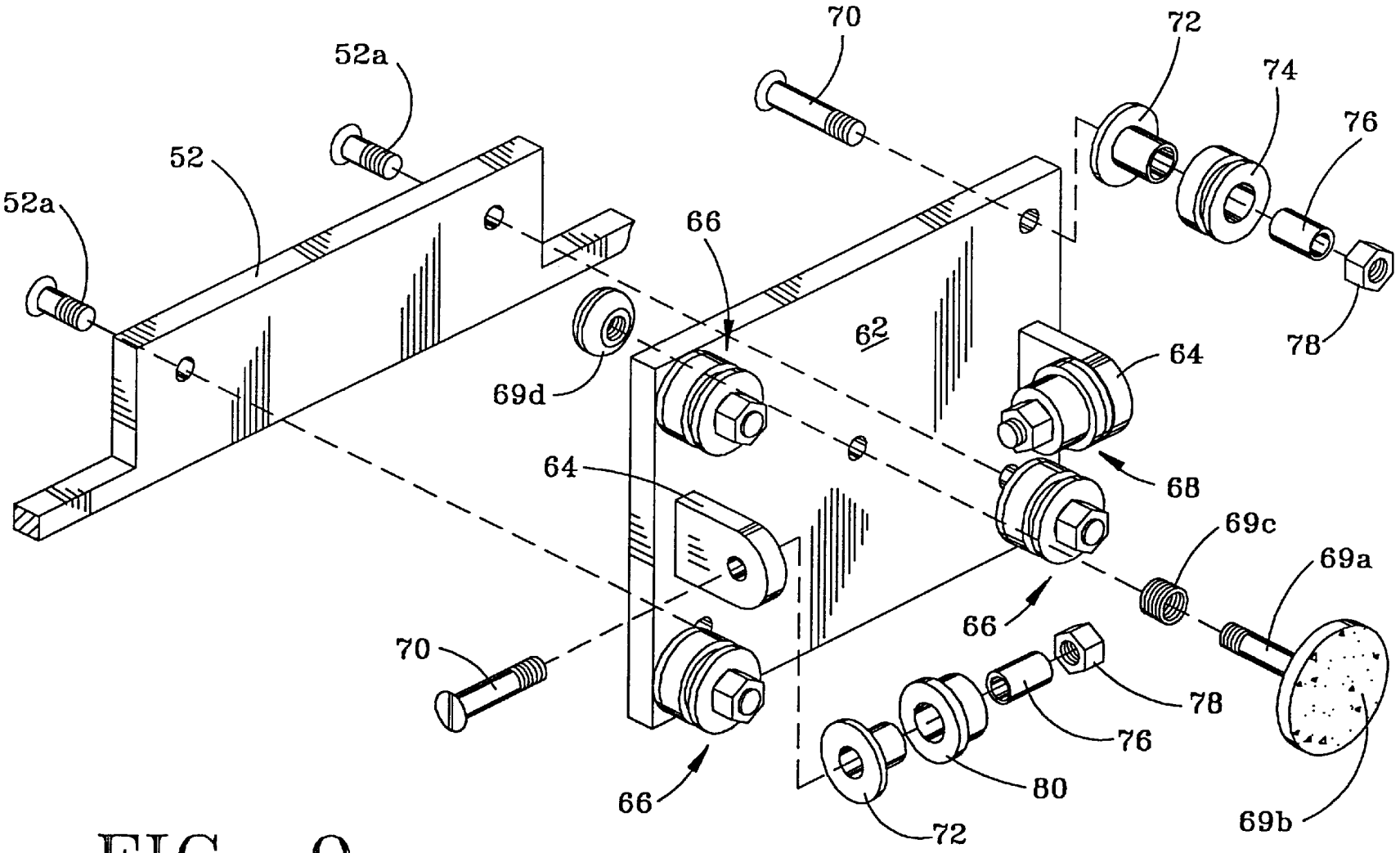
FIG. 9 is an exploded view of the mast truck.
Figure 10:
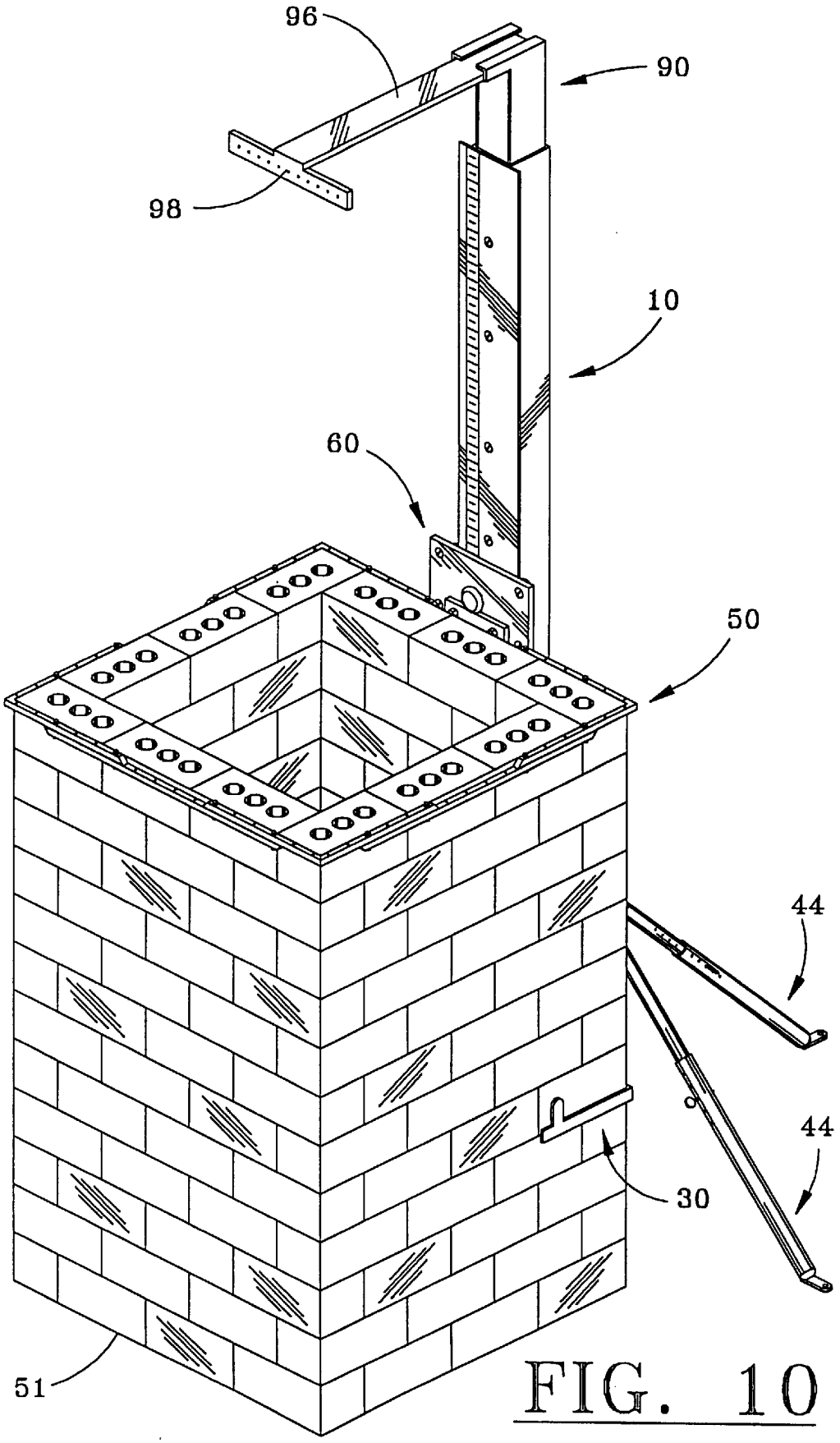
FIG. 10 is an isometric view of the preferred embodiment in use with a brick column.
Figure 12:
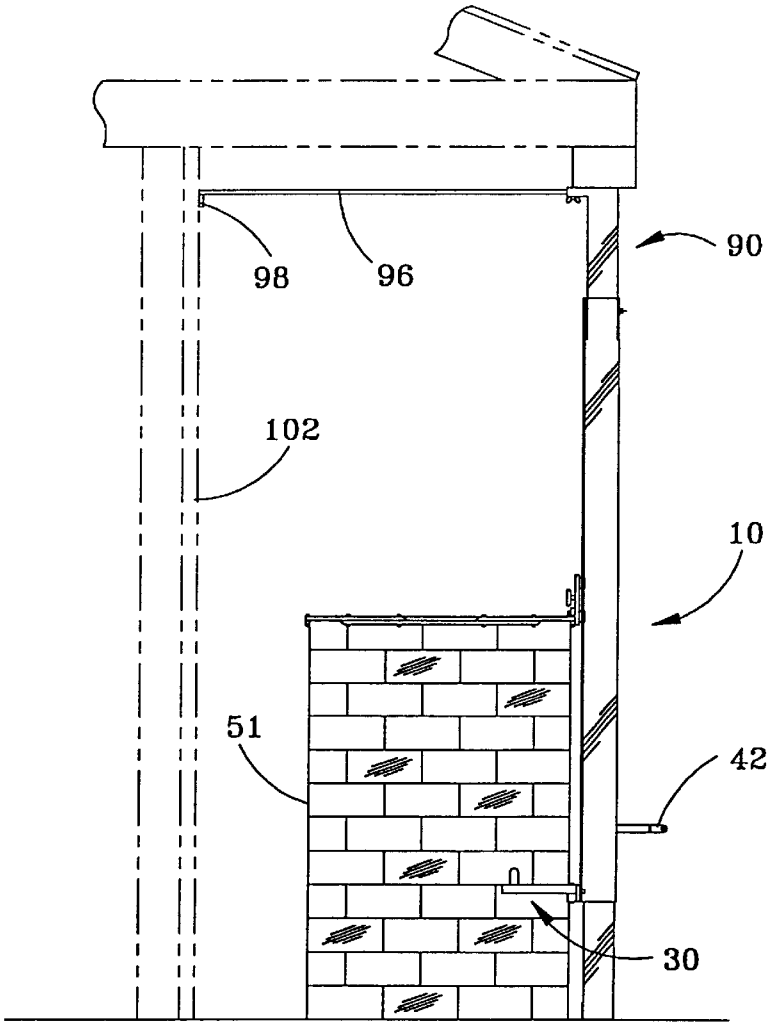
FIG. 12 is a vertical elevation view of the preferred embodiment shown attached to an existing structure adjacent a brick column.
Figure 11:
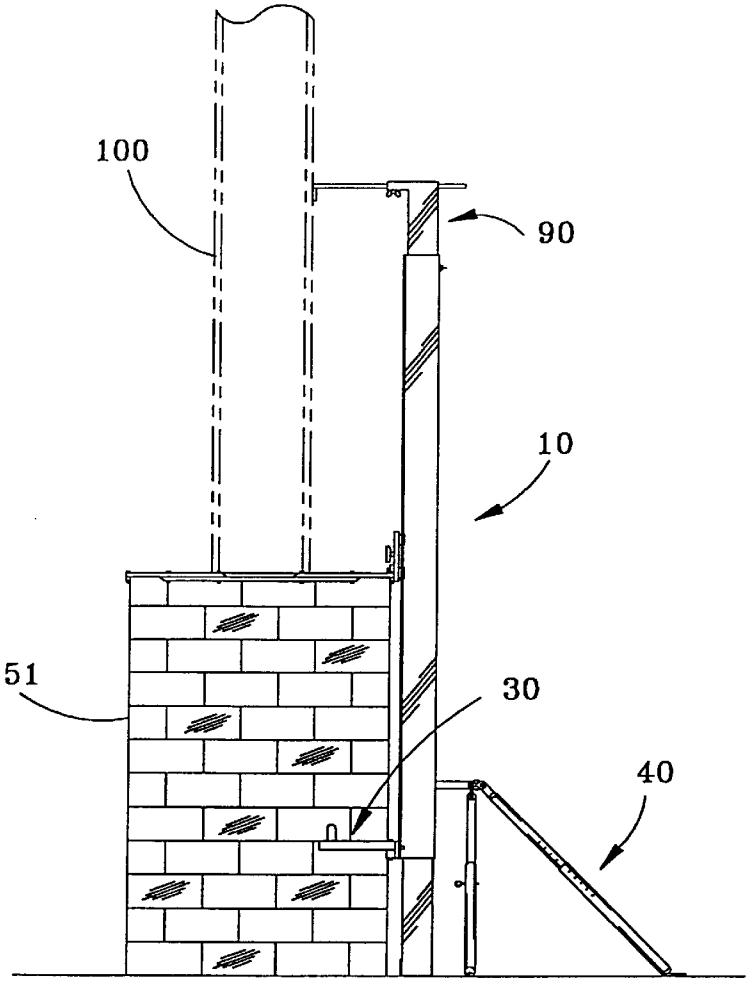
FIG. 11 is a vertical side elevation view of the preferred embodiment shown attached to a support column.

The brick column guide 10 shown first in FIG. 1 is comprised of several assemblies and weldments, the first being a vertical column or mast comprised of a channel member 12 and a lower foot or stabilizer angle bar 14 transversely attached perpendicularly via screws 13 seen in FIG. 6 to the channel member's lower end. The second assembly 20 comprises a box tube 16 having an interior dimension capable of receiving the channel member 12 in a telescopic manner, a mast face or guide plate 18 having a steel rule 19 with incremental indicia thereon, the face plate being attached via screw 15 to an exterior face of the box tube 16 as shown in FIG. 6, and a lower extendible guide assembly 30 transversely attached perpendicularly to the lower end of the face plate 18. The lower guide assembly 30 is adjustably fitted to the first and or second and subsequent courses of bricks in the column and is moved upwards only as needed to extend the mast length via the lower telescopic member 12, thus maintaining a stable column guide for the vertical mast 20. The third assembly is a vertical stabilizer 40 comprised of a weldment 42 and three telescopically adjustable legs 44 pivotally attached to the weldment 42 by bolts and wing nuts 46, 48 as best seen in FIG. 5. The weldment 42 is attached to the inner wall of the channel 12 by screws 49, at least one of which extends beyond the channel 12 and contacts the inner wall of the box tube 12, thus when tightened exerts a force between the channel 12 and the box tube 16, thereby securely positioning the box tube 15 relative to the channel 12. It should also be noted that the box tube 16 is provided with a slot 22 seen in FIG. 2 and 4, and an opening 24 to allow insertion of the weldment or connection arm 42 and its attachment, to be connected to the channel 12. The slot allows longitudinal movement of the weldment 42 relative to the box tube 16. The adjustable legs 44, seen in FIGS. 1–6, best seen in FIG. 6, further comprise upper and lower telescopic members 44*a*, 44*b*. Both leg telescopic members 44*a*, 44*b* are fitted with eyelet tangs 44*c*, 44*d* at ends opposite their telescopic portion. However, the eyelet tang 44*d* at the end of lower member 44*b* is bent at approximately 45 degrees. Earth spikes or long nails (not shown) may be used to anchor the lower member 44*b* via its eyelet tang 44*d* to the earth. Each of the leg telescopic members 44*a*, 44*b* have a plurality of holes 44 provided therein and a pin 44*f* for penetrating both members, thus retaining the upper member 44*a* relative to the lower member 44*b*. The telescopic legs 44 provide vertical stabilization for the mast 20 and control vertical plumb in two planes. The lower guide assembly 30 comprises a plate 32 and support bar 34 as best seen in FIG. 6, the bar 34 being attached to a plate 32 for bolting to the face plate 18 with screws, 35 left and right guide bars or arms 36, 38 are incrementally secured to the support bar 34 with screws 39 which may be inserted through a plurality of holes, thus allowing the left and right guide bars 36, 38 to be extended horizontally. The left and right guide bars 36, 38 further comprise horizontal guide bars 37, having vertical tangs 40. The horizontal guide bars 40 being attached at right angles to the left and right guide bars 36, 38. The fourth assembly 50, first seen in FIG. 1, is comprised of an extendible frame or hoop 50 and a mast truck assembly 60. The extendible frame assembly 50 attaches to the mast truck assembly 60 and is comprised of a main support bar 52 attached to corner bars 54, seen in FIG. 6, via screw 57 which are connected by spacer bars 56. Spacer bars 56 attach each of the corner bars 54 in an incremental manner so as to allow for a close peripheral fit for various size brick columns 51 as shown in FIG. 10. The frame 50 therefore provides a peripheral guide for each course as it is laid. The mast truck assembly 60, best seen in FIG. 7–9, includes a base plate 62 having a pair of eyelet tabs extending perpendicularly thereto, four grooved roller bearing assemblies 66 extending perpendicular to the base plate 62, two roller type bearing assemblies attached perpendicularly to the eyelet tabs 64 and a tensioner assembly 69. The tensioner assembly comprises a shaft portion 69*a* having a foot plate 69*b*, a spring 69*c* and a knob 69*d*. The tensioner shaft 69*a* passes through the spring 69*c* and the base plate 62, as seen in FIG. 9, and threadably engages the knob 69*d*, thus maintaining a spring force on the foot plate 69*b* which in turn applies tension between the base plate 62 and the face plate 18 as seen in FIGS. 7 and 8. As further seen in FIGS. 7, 8, and disassembled in FIG. 9, the grooved roller assemblies 66 are configured to engage the edges of the face plate 18. Roller bearings 68 further engage the side of face plate 18 opposite the side adjacent the truck base plate 62, thus capturing the face plate 18 in a secure manner while allowing the mast truck assembly 60 and the extendible frame assembly 50 to roll vertically relative to the mast assembly 20. Infinite adjustment of the truck assembly 60 and its associated frame guide 50 along the brick column 51, as shown in FIG. 10, is obtained by pulling the knob 69*d*, thus releasing tension between the mast truck and the face plate 18. A non-skid material may be applied to the foot plate 69 to help increase friction between the foot plate 69 and the faceplate 18. An alternate method of locking the mast truck to the face plate is to provide a resilient member 100 extending through the mast truck base plate 68 adjacent one of the grooved rollers 66 as seen in FIGS. 7 and 8, thus, by wedging the resilient member between the grooved roller and the edge of the face plate, a scotch lock is achieved. As seen in FIG. 9, the truck base plate assembly 60 comprises the mast truck base plate 62 to which is attached the frame support bar 52 by screws 52*a*, four grooved roller assemblies 66 and two roller type bearing assemblies 68 and the tensioner assembly 69. Each grooved roller assembly 66 is comprised of a spindle 70 passing through the base plate 62, a flanged sleeve 72, slidable on the spindle 70, a grooved roller 74, an inner bushing 76 pressed into the grooved roller rotatable upon the flanged sleeve 72, and a nut 78 threadable upon said spindle 70. The roller assembly 68 is assembled similarly to the grooved roller assembly 66, except that the roller 80 is not grooved. The final assembly 90 is an ancillary adjustable frame bar for attachment to an existing vertical support column 100, around which the brick column is being built as seen in FIG. 11 or an existing structure 102 as shown in FIG. 12, which may be located adjacent the brick column 51 under construction utilizing the brick column guide 10 disclosed herein. As seen in FIGS. 1–3, this assembly comprises a channel member 92 which is telescoped within the upper portion of the box tube assemble 20 and telescopically adjustable via set screw 93 seen in FIG. 6, the channel member 92 having a perpendicular receptive channel 94 at one end for receiving a slidable flat bar 96. The flat bar 96 further includes a perpendicular portion 98, thus forming a t-bar, the cross bar having holes therein for allowing fasteners to pass into the existing structure 100, 102. The flat bar 96 is retained and positioned relative to the receptive channel 94 via a wing bolt 99 threaded into channel member 92 located below the slidable flat bar 96. Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not intended to limit the invention.

What is claimed is:

1. A brick column, construction guide apparatus comprising:

a) an elongated vertical mast comprising an upper portion and a lower telescopic channel portion;

b) an alignment means pivotally attached to said lower telescopic channel portion for maintaining vertical plumb in two planes, said alignment means further comprising at least two telescopic legs;

c) a rolling truck in frictional contact with a portion of said mast upper portion; and d) a hoop member attached horizontally to said rolling truck.

2. A brick column, construction guide apparatus according to claim 1 wherein said mast upper portion further comprises an elongated face plate attached to an exterior face of said upper mast portion.

3. A brick column, construction guide apparatus according to claim 2 wherein said mast upper portion further comprises a lower frame guide transversely attached to said face plate.

4. A brick column, construction guide apparatus according to claim 3 wherein said elongated face plate has a steel rule, scale attached to a face thereof.

5. A brick column, construction guide apparatus according to claim 4 wherein said rolling truck further comprises a plurality of rollers which engages said elongated face plate on at least two sides.

6. A brick column, construction guide apparatus according to claim 5 wherein said truck further comprises a spring loaded brake means for fractionally locking said mast truck in position relative said face plate.

7. A brick column, construction guide apparatus according to claim 6 wherein said mast truck further comprises an adjustable guide hoop attached perpendicularly thereto.

8. A brick column, construction guide apparatus according to claim 1 wherein said lower telescopic channel portion further comprises a stabilizer bar transversely attached adjacent exposed end of said lower telescopic portion.

9. A brick column, construction guide apparatus according to claim 2 wherein said alignment means further comprises a weldment means for connecting said telescopic legs to said mast lower telescopic channel portion, said weldment being removably attached to said mast telescopic lower channel portion and extending outwardly through a slot in a wall of said mast upper portion, opposite said face plate, in a manner whereby said weldment means and said lower telescopic portion remain slidable relative to each other.

10. A brick column, construction guide apparatus according to claim 9 wherein said weldment means is attached to said mast lower telescopic channel portion with screws which extend beyond said telescopic potion and are in frictional contact with an inner wall of said mast upper portion when said screws are fully tightened, thus locking said mast upper portion to said lower telescopic portion.

11. A brick column, construction guide apparatus according to claim 1 wherein said mast upper portion further comprises an upper telescopic member, said upper telescopic member being infinitely adjustable.

12. A brick column, construction guide apparatus according to claim 11 wherein said upper telescopic member further comprises a transverse channel means located at one end of said upper telescopic member for receiving telescopically, a flat bar having a perforated, transverse member at an end opposite end in contact with said channel means.

13. A brick column, construction guide apparatus comprising:

a) an elongated tubular portion;

b) an elongated lower channel member telescopically inserted inside said elongated tubular portion;

c) an elongated face plate attached to an external face of said elongated tubular portion;

d) a lower guide frame transversely attached to said face plate adjacent said lower channel member;

e) a vertical alignment means attached to said lower channel member for holding said lower channel member and said elongated tubular portion plumb in two planes;

f) a truck in rolling contact with said face plate; and g) an upper guide frame transversely attached and extending outwardly perpendicularly to said truck.

14. A brick column, construction guide apparatus according to claim 13 wherein said lower guide frame comprises left and right guide bar arms which are incrementally extendible relative to a support bar, said left and right arms further comprise right angles.

15. A brick column, construction guide apparatus according to claim 13 wherein said vertical alignment means further comprises at least two pivotally attached telescopic leg members.

16. A brick column, construction guide apparatus according to claim 13 wherein said truck further comprises grooved rollers in rolling contact with at least two sides of said face plate.

17. A brick column, construction guide apparatus according to claim 13 wherein said apparatus further comprises an elongated upper channel member telescopically inserted inside said elongated tubular portion, said elongated upper channel member comprising a transverse channel and a horizontal t-bar member slidable within said transverse channel, said t-bar and said upper channel member being infinitely adjustable via set screws.

18. A process for constructing a brick column using an adjustable column guide comprising the steps of:

a) erecting a column construction guide comprising:

i) an elongated vertical mast comprising an upper portion and a lower telescopic channel portion;

ii) an alignment means pivotally attached to said lower telescopic channel portion for maintaining vertical plumb in two planes, said alignment means further comprising at least two telescopic legs;

iii) a rolling truck in frictional contact with a portion of said mast upper portion;

iv) a hoop member attached horizontally to said rolling truck; and v) a lower guide bar attached to a lower end of said vertical mast;

b) laying and leveling at least a first and second course of bricks in a column;

c) adjusting said lower guide bar to make sliding contact with said first and second courses;

d) anchoring and adjusting said alignment means to insure mast plumb in two planes;

e) adjusting said upper hoop and said truck linearly relative to said mast and peripherally in contact with said brick column first and second courses; and f) repositioning said upper hoop incrementally relative to said mast as each course of brick is laid using said hoop as a guide.

19. A process for constructing a brick column using an adjustable column guide comprising the steps of:

a) erecting a column construction guide comprising:

i) an elongated vertical mast comprising an upper portion and a lower telescopic channel portion;

ii) an alignment means pivotally attached to said lower telescopic channel portion for maintaining vertical plumb in two planes, said alignment means further comprising at least two telescopic legs;

iii) a rolling truck in frictional contact with a portion of said mast upper portion;

iv) a hoop member attached horizontally to said rolling truck; and v) a lower guide bar attached to a lower end of said vertical mast;

b) laying and leveling at least a first and second course of bricks in a column;

c) adjusting said lower guide bar to make sliding contact with said first and second courses;

d) anchoring and adjusting said alignment means to insure mast plumb in two planes;

e) adjusting said upper hoop and said truck linearly relative to said mast and peripherally in contact with said brick column first and second courses;

f) repositioning said upper hoop incrementally relative to said mast as each course of brick is laid using said hoop as a guide;

g) repositioning said mast as necessary by extending said lower telescopic member; and h) inserting an upper channel member telescopically into an upper end of said mast and extending a portion thereof to make contact with an existing structure around which said brick column is being built and securing said extending portion thereto.

* * * * *